United States Patent [19]

Abe et al.

[11] Patent Number: 4,574,170

[45] Date of Patent: Mar. 4, 1986

[54] MULTI-POLAR CIRCUIT BREAKER

[75] Inventors: Ken-ichi Abe; Ryoji Ozaki, both of Kawasaki, Japan

[73] Assignee: Fuji Electric Co., Ltd., Tokyo, Japan

[21] Appl. No.: 642,496

[22] Filed: Aug. 20, 1984

Related U.S. Application Data

[63] Continuation-in-part of Ser. No. 508,050, Jun. 27, 1983, abandoned.

[30] Foreign Application Priority Data

Jul. 15, 1982 [JP] Japan ..... 57-122131

[51] Int. Cl.[4] ..... H01H 21/54

[52] U.S. Cl. ..... 200/153 G; 200/50 C; 200/73; 335/8; 335/160

[58] Field of Search ..... 200/153 G, 153 H, 146 R, 200/73, 50 C; 335/8, 18, 160, 161

[56] References Cited

U.S. PATENT DOCUMENTS

| | | | |
|---|---|---|---|
| 489,553 | 1/1893 | Baehr | 200/73 |
| 568,450 | 7/1896 | Meek | 200/73 |
| 3,427,419 | 2/1969 | Findley, Jr. | 200/255 |
| 4,002,870 | 1/1977 | Phillips | 200/146 R |
| 4,295,025 | 10/1981 | Beatty, Jr. et al. | 200/153 H |
| 4,383,146 | 5/1983 | Bur | 200/17 R |

FOREIGN PATENT DOCUMENTS

| | | | |
|---|---|---|---|
| 302543 | 10/1932 | Italy | 335/8 |
| 534435 | 10/1955 | Italy | 200/153 H |

*Primary Examiner*—Stephen Marcus
*Assistant Examiner*—Renee S. Kidorf
*Attorney, Agent, or Firm*—Bruce L. Birchard

[57] ABSTRACT

By articulating the neutral-pole switching element in a multi-pole circuit breaker, providing spring biasing to urge the two elements into a pre-determined position approximating alignment, advancing the neutral pole switching element with respect to the other switching elements and providing fixed contact elements which frictionally engage opposite sides of the neutral-pole switching contact in the closed position, the closing of the neutral circuit precedes the closing of the live circuits and the opening of the neutral circuit lags the opening of the live circuits, thus preventing arcing and transient damage to loads on the circuit.

11 Claims, 6 Drawing Figures

MULTI-POLAR CIRCUIT BREAKER

RELATED CO-PENDING APPLICATION

This application is a continuation-in-part of prior application Ser. No. 508,050 bearing the same title; filed June 27, 1983 in the name of the same inventor and now abandoned.

BACKGROUND OF THE INVENTION

1. Field of the Invention

This invention relates to electrical circuit breakers and more particularly to multi-polar circuit breakers particularly those for use in electrical power circuits having a neutral conductor.

2. Prior Art

Molded case-circuit breakers or earth-leakage breakers which are used as low-voltage circuit breakers, generally have a neutral-pole for switching the neutral conductor and three live poles for switching the voltage-carrying conductors.

In a multi-polar circuit breaker of this kind, it is desirable that the neutral pole have advanced making and delayed breaking actions in order to obtain stable performance and to minimize arcing upon the making and breaking of the circuit. In order to achieve the desired delayed breaking action upon the opening of the pole, it is necessary to cause the opening of the contact element in the neutral pole to lag the opening of the contact elements of the three voltage-carrying poles by a time sufficient to prevent the neutral pole from opening before any arc in the voltage-and-current-carrying poles is extinguished.

Conventional multi-polar circuit breakers have the problem that they cannot obtain the time difference required between the opening of the neutral pole and the opening of the other poles because they are so constructed and dimensioned that they perform advanced making and delayed breaking action using a contact structure for the neutral pole which is not substantially different from that of the three voltage-and-current-carrying poles. In particular, when the circuit is being closed, only if the neutral pole contact element is closed slightly before the contact elements of the three poles connected to the live conductors are closed, will no problem arise. On the other hand, when the conventional circuit breakers open, even if the contact elements of the voltage and current-carrying poles are mechanically opened, the neutral contact element is opened as the contact elements of the three live poles are effectively closed by arching. Therefore, effectively, the opening of the contact element of the neutral pole does not lag, by a sufficient time, the opening of the contact elements of the three live poles. Under those conditions, if a good load balance is not established among the poles switching the live conductors, a transient high voltage may be developed between one of the three live poles and the neutral pole, thus damaging any devices connected between that live pole and the neutral pole.

Therefore, it is an object of this invention to overcome the various disadvantages and problems set forth hereinbefore.

It is a further object of this invention to provide an improved multi-polar circuit breaker which provides appropriately advanced making and delayed breaking functions for the neutral pole relative to the other poles thereby preventing damage to associated loads.

SUMMARY OF THE INVENTION

The neutral-pole movable switching element in a multi-polar circuit breaker is articulated to give a holder portion and a contact portion rotatably supported therefrom and spring-biased away from its associated bifurcated fixed contact member and knife-edges to form a knife-edged switch with the fixed contact member. The respective movable switching elements of the other poles are not articulated and are not knife-edged. Further, the neutral pole movable switch contact is slightly advanced so as to make contact with its fixed contacts in advance of the movable switching elements for the other poles. Thus, as the switch is closed, the neutral pole closes first. On the other hand, in the opening or breaking phase of the operation, the neutral pole does not open until the tie-bar interconnecting the movable elements of all the poles, and the live poles, themselves, have rotated thru a pre-determined angle and the movable contacts of the live poles are safely separated from their respective fixed contacts. A stop on the holder in the articulated moving contact of the neutral pole then causes the two elements of that contact to move in unison and the neutral pole then opens. The delayed "breaking" action thus achieved prevents transient damage to equipment connected to the controlled power circuits.

BRIEF DESCRIPTION OF THE DRAWINGS

The invention and wherein it constitutes an advance over the prior art can best be understood by reading the disclosure herein in connection with the drawings herein, in which.

DETAILED DESCRIPTION OF THE PREFERRED EMBODIMENTS

Figure 1:
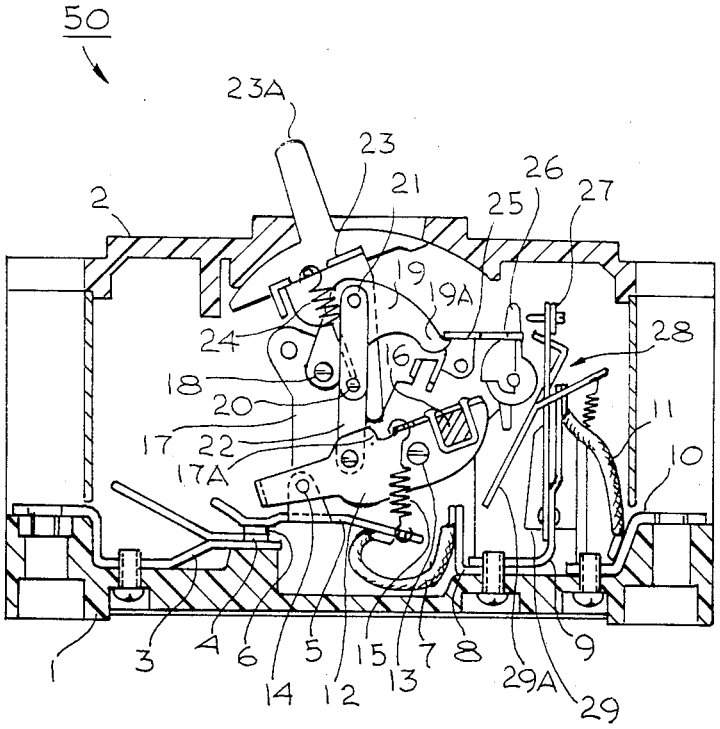
FIG. 1 is a partially cross-sectional view showing one example of the structure of one pole associated with one conductor carrying voltage in a multi-polar circuit breaker according to the present invention.

Referring to FIG. 1, there is shown one of the current and voltage-carrying switching elements in the multipolar circuit breaker according to the present invention. A four-pole circuit breaker has three poles of such a construction, plus a neutral pole for use in opening and closing the neutral line. Circuit breaker 50 includes a casing 1 made from insulating material and a cover 2 also made from insulating material and covering the casing. Mounted on the casing 1 is a stationary terminal conductor 3 having a stationary contact 4. A movable contact element 5 has a movable contact 6, which is pressed firmly against the contact 4 in the "making" or closed condition as shown. The element 5 is connected to a heater 9 via a flexible conductor 7 and an intermediate connecting element 8, and the heater 9 is connected to a connecting terminal 10 on the load side by a flexible conductor 11. Rotatable around a shaft 13 is a holder 12, which is interlocked with the movable contact element 5 via a pin 14. Spring 15, anchored to the holder 12 and to the contact element 5, exerts a force pressing contact 6 of the element 5 against contact 4.

The holder 12 is provided with a tie-bar 16, which consists of insulating material and acts to rotate, in unison, the holders (not shown) of the other poles secured to tie-bar 16 as the holder 12 rotates around the shaft 13. Shaft 13 is supported in a frame 17. Further, toggle links 21 and 22 which are part of the opening and closing mechanisms are disposed between a trip lever 19 and holder 12 and are connected by a toggle link shaft 20. The lever 19 is mounted on the frame 17 via a shaft 18 which allows angular movement of lever 19 around shaft 18. A switching lever 23 has a handle 23A for manually opening and closing circuit breaker 50 and a lower portion, which is pivotally secured to pivot 17A of the frame 17. A toggle spring 24 is anchored to the lever 23 and to the toggle link shaft 20.

Lever 19 is part of an overcurrent tripping mechanism, cooperating with hook 25. When the circuit is closed, the hook remains engaged by an engaging claw 19A. When the circuit is tripped, as is described hereinafter, a tripping member 26 is rotated causing hook 25 to rotate. The result is that the hook 25 is disengaged from the claw 19A and lever 19 is rotated around shaft 18 in a counter-clockwise direction. A bimetal strip 27 mounted in an overcurrent tripping mechanism 28 bends if an overcurrent flows through heater 9. Bimetal strip 27 is heated by the excess heat from heater 9. Then the head of the bimetal strip 27 presses the member 26 to bend it, thus causing lever 19 to perform an opening operation via hook 25. Current surges, or transients, cause arm 29A to be attracted, at one end, to electromagnet 29, as a result of which its opposite end engages member 26, causing lever 19 to perform the aforementioned opening operation via hook 25.

Figure 3:
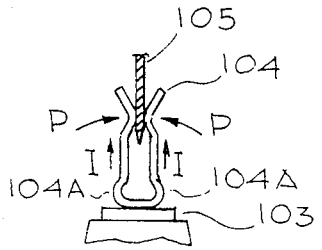
FIG. 3 is a schematic representation of an elevational view as taken along the line A—A of FIG. 2 showing the condition in which the movable contact element of the neutral pole of FIG. 2 is engaging the stationary contact element thereof.
Figure 2:
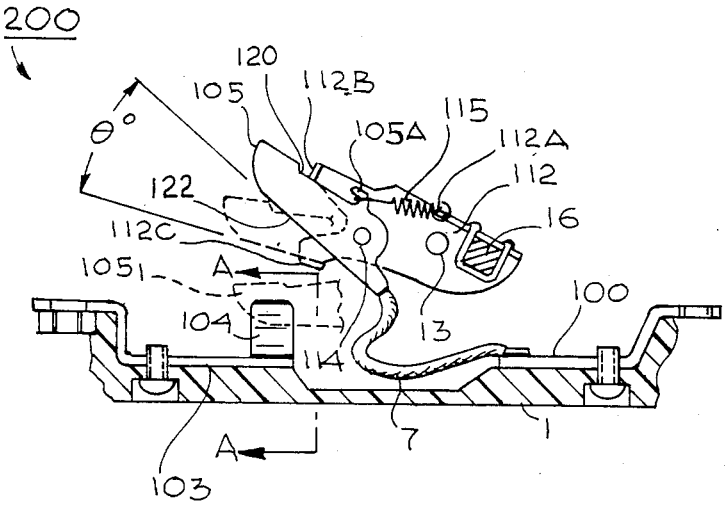
FIG. 2 is a partially cross-sectional view showing, for the circuit breaker of FIG. 1, a first embodiment of the neutral pole construction.

Referring to FIG. 2, the structure of the neutral pole 200, according to this invention, is shown. In FIG. 2, stationary terminal conductor 103 includes a stationary contact element 104. Also shown is a movable contact element 105. Element 105 is shown in an "open" state and, therefore, element 105 is disengaged from the element 104. The elements 104 and 105 together constitute a knife-edged contact. In particular, the stationary contact element 104 is constructed as shown in FIG. 3 and has opposed flexible portions 104A, the resilience of which imparts to the knife-edges movable contact element 105 contact pressures P in the directions shown by the arrows. The phantom-line element 1051 in FIG. 2 shows the "closed" condition of the neutral pole 200 wherein the element 105 is held firmly between the resilient portions 104A of contact 104. It is to be understood that in such a knife-edged contact, when the contact is closed, current I (FIG. 3) flows into the two resilient portions 104A of contact element 104 of the neutral pole in the same direction. The resultant electromagnetic action produces an attraction between the elements 104 and 105, thereby increasing the contact pressures further.

The movable contact element 105 is connected to a neutral pole holder 112 by a pin 114, as shown in FIG. 2. A spring 115, anchored to the spring engaging portion 105A of the movable element 105 and to the engaging portion 112A of the holder 112, biases the movable contact element 105 in a clockwise direction, causing its first edge 120 to abut against stop 112B of the holder 112. Holder 112 is provided with a hook 112C which is so constructed that if the element 105 has rotated, relatively, around the pin 114 through an angle of 0° in a counter-clockwise direction against the restoring force of spring 115, second edge 122 of element 105 will abut against hook 112C.

Up to that point contact element 105 remains in the position indicated by the phantom line 1051, i.e., it is held between the portions 104A of the element 104 by the contact pressures. However, as holder 112 is rotated further, clockwise, element 105 is urged to rotate with holder 112, thereby finally allowing an open-circuit condition to arise for the neutral pole 200. Therefore, the open-circuit condition for the neutral pole 200 lags, in time, the open-circuit condition for the movable element 5 of any other pole, by the time taken by the element 105 to rotate through an angle of $\theta°$. This mechanism assures delayed breaking of the neutral circuit. Further, when the element 105 is disengaged from the element 104, the restraining forces imposed on the interposed element 105 by the resilience of the elements 104A disappear and element 105 is free to rotate around the pin 114 in a clockwise direction in response to the restoring force of the spring 115, until it abuts on the stop 112B. In the final condition of the open-circuit operation, a desired spacing can be established and maintained between the elements 105 and 104. A neutral pole terminal conductor 100 is connected to the element 105 by the flexible conductor 7.

Figure 4:
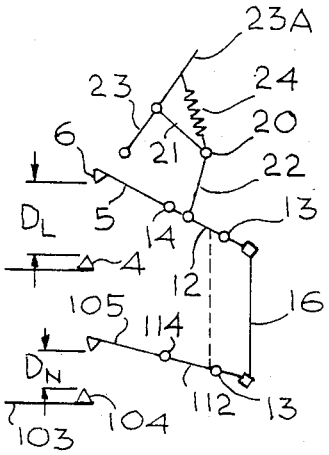
FIG. 4 is a schematic diagram illustrating an interlocking mechanism for the movable contact element of a multi-polar circuit breaker, according to this invention.

FIG. 4 is a schematic diagram showing the relationship between switching elements in the circuit breaker according to this invention. In FIG. 4 the components are arranged and constructed so that the relation $D_L > D_N$ holds, where $D_L$ is the distance of the movable element 6 from the element 4 in a live pole and $D_N$ is a similar distance in the neutral pole. As a result, whenever the circuit is closed, the element 105 of the neutral pole is brought into contact with the element 104 before the movable elements 5 of the poles in the live conductor portion of circuit breaker 50 come into contact with their related fixed contacts. Thus, energization of the neutral pole is effected prior to energization of the other poles. It is to be noted, however, that it is also required that the separation distance in the neutral pole be kept at a given value. Accordingly, it is not possible to make the separation distance $D_L$ much greater than the distance $D_N$. Nonetheless, as long as any difference exists between the distances, advanced "making" of the neutral pole can be realized.

Figure 5:
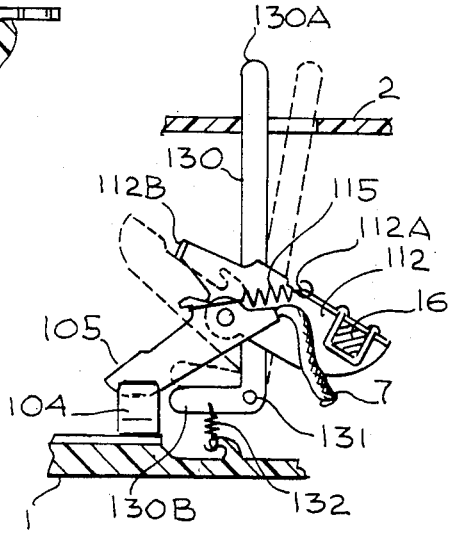
FIG. 5 is a partially sectioned view showing an alternative embodiment for the construction of the neutral pole switching contacts according to the present invention; and, FIG. 6 is a mechanical drawing, partially schematic, partially isometric, showing the differing switch contacts involved in the present invention and their special relationships.

Referring to FIG. 5, there is shown another example of the present invention. In this example, the neutral pole can be manually opened only when a need arises. Usually, the neutral pole is kept conducting at all times to obtain the same effect as advanced "making" and breaking of the pole would achieve. Specifically, an insulating lever 130 rotatable around a shaft 131 is kept in a position as indicated by the solid line in FIG. 5 by the force exerted by a return spring 132. The spring is anchored to the casing 1 and to the lever. This structure has no part similar to the hook 112C shown in FIG. 2. Therefore, if it is required that the neutral pole be opened, a handle 130A protruding from the cover 2 above the lever 130 is moved to the position indicated by the phantom line. The heel 130B of the lever, being aligned with element 105 pushes that element upward and urges it to disengage from the element 104, after which the spring 115 pulls it upward to engage hook 112B which is a position sufficient to keep the desired separation distance so that arcing is avoided. The advanced closing of contacts 104 and 105 is as was described in connection with FIG. 2.

Although in the foregoing examples the stationary contact element in each case had resilient portions the resilience of which is utilized to assure firm electrical and mechanical contact, another spring may be provided, to sandwich the movable contact element in the fixed elements.

Figure 6:
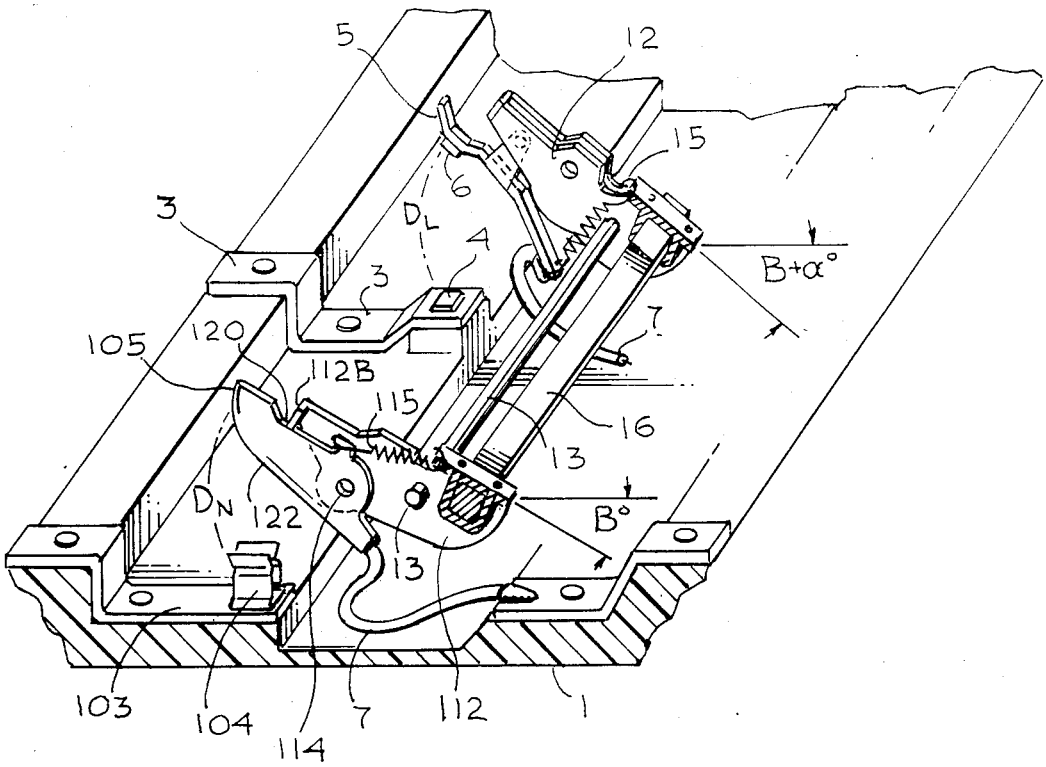

In FIG. 6, the switch contacts of FIGS. 1 thru 4 are shown in a single structure. Elements 104 and 105 in FIG. 6 constitute the knife-edge contact with which the neutral pole is switched, according to the present invention.

The "line" poles are switched by the combination of holder 12, movable contact element 5 and movable contact 6 which engages stationary contact 4. It is to be noted that element 105 is advanced with respect contact element 5 so that the arcuate distance $D_n$ thru which element 105 must move before making contact with contact element 104 is less than the arcuate distance $D_1$ thru which movable contact 6 must move before engaging stationary contact 104.

This differential may be achieved by an angular setback of $\alpha°$ for holder 12.

While particular embodiments have been shown and described it will be apparent to those skilled in the art that modifications and variations may be made in the structures without departing from the scope or spirit of this invention. It is the purpose of the appended claims to cover all such variations and modifications.

We claim:

1. A multi-polar circuit breaker for switching multiple lines, including a neutral line and a voltage-carrying line, in an electrical power system, including:

a neutral-line switching assembly and a voltage-carrying-line-switching assembly;

said voltage-carrying-line-switching assembly including a first holder, a first movable contact element carried by said first holder in pivotable relationship thereto, and a first fixed contact element;

said neutral-line-switching assembly including a second holder, a second movable contact element carried by said second holder in pivotable relationship thereto and a second fixed contact element;

said second movable contact element having a first edge remote from said second fixed contact element;

a first stop carried on said second holder for engaging said first edge of said second movable contact element to limit the pivoting of said second contact element in a first direction;

a spring coupled between said second movable contact element and said second holder for biasing said second movable contact element pivotably towards said first stop;

said neutral-line-switching assembly and said voltage-carrying-line-switching assembly being interlinked by a tie-bar for motion of said holders in unison, said second movable contact element being spaced from said second fixed contact element, in the opened condition of said neutral-line-switching assemlby, a distance less than the spacing of said first movable contact element from said first fixed contact element, in the opened condition of said voltage-carrying-line-switching assembly.

2. Apparatus according to claim 1 in which said second movable contact element has a second edge proximate to said second fixed contact and said second holder has a second stop portion for limiting the pivoting of said second movable contact element in a second direction.

3. Apparatus according to claim 1 which includes, in addition, a case and an operating lever pivotally supported from said case, said operating lever having a handle portion and a heel portion, said heel portion being positioned to engage, upon pivoting of said operating lever, said second movable contact element for dis-engaging said second movable contact element from said second fixed contact element.

4. Apparatus according to claim 1 in which said circuit breaker includes excessive-current protection means.

5. Apparatus according to claim 1 in which said tie-bar is of insulating material.

6. Apparatus according to claim 1 in which said second movable contact element has a second edge proximate to said second fixed contact; said second holder has a hook thereon for limiting the pivoting of said second movable contact element in a second direction; and said second fixed contact element forcefully but releasably engages said second movable contact element in the closed condition of said voltage-carrying-line-switching assembly and releases said second movable contact element only when the pivoting force applied to said second movable contact element by the engagement of the second edge thereof with said hook exceeds the retaining frictional force imposed upon said second movable contact element by said second fixed contact element.

7. Apparatus according to claim 1 in which said first movable contact element is spring biased into firm contact with said first fixed contact element during the closed state of said voltage-carrying-line-switching assembly.

8. Apparatus according to claim 1 in which said second stationary contact element comprises a pair of opposing proximate, metallic faces, biased into contact with each other.

9. Apparatus according to claim 8 in which said bias is inherent in the resilient nature of the material making up said second stationary contact element.

10. Apparatus according to claim 1 in which said first fixed contact element is a flat metallic contact and said second fixed contact element is a pair of opposed, interconnected resilient metal strips biased into contact with each other but constructed to separate upon the forceful interposition of said second movable contact element.

11. Apparatus according to claim 10 in which said second fixed contact element forcefully engages said second movable contact element in the closed condition of said voltage-carrying-line-switching assembly.

* * * * *